United States Patent [19]

Tokita

[11] 4,361,118

[45] Nov. 30, 1982

[54] COOLING APPARATUS OF COMBUSTION CHAMBERS FOR WATER-COOLED ENGINES

[75] Inventor: Yoshihiro Tokita, Sakaishi, Japan

[73] Assignee: Kubota, Ltd., Japan

[21] Appl. No.: 211,675

[22] Filed: Dec. 1, 1980

[30] Foreign Application Priority Data

Feb. 26, 1980 [DE] Fed. Rep. of Germany ..... 55-24455[U]
Feb. 26, 1980 [JP] Japan ..... 55-24456[U]

[51] Int. Cl.[3] ..... F01P 11/02
[52] U.S. Cl. ..... 123/41.15; 123/41.54
[58] Field of Search ..... 123/41.15, 41.27, 41.54, 123/41.2; 165/51, DIG. 24; 236/61

[56] References Cited

U.S. PATENT DOCUMENTS

| | | | |
|---|---|---|---|
| 3,820,593 | 6/1974 | Pabst | 123/41.54 X |
| 3,921,600 | 11/1975 | Henning | 123/41.54 |
| 4,182,404 | 1/1980 | Beveridge et al. | 123/41.54 X |
| 4,200,065 | 4/1980 | Buddenhagen | 123/41.54 |

*Primary Examiner*—William A. Cuchlinski, Jr.
*Attorney, Agent, or Firm*—Bacon & Thomas

[57] ABSTRACT

The present invention relates to a cooling apparatus of the combustion chambers for water-cooled engines. When operating a water-cooled engine in inclined condition toward front, the steam gathers in the upper backward of the water-jacket, and this causes overheating. This invention solves above problem by means of providing a steam relief port which is connected with a pressure regulating cap.

6 Claims, 3 Drawing Figures

COOLING APPARATUS OF COMBUSTION CHAMBERS FOR WATER-COOLED ENGINES

BACKGROUND OF THE INVENTION

1. Field of the Invention

This invention relates generally to a cooling apparatus for combustion chambers of water-cooled engines, and more particularly to a steam relief device at the upper backward part in the water-jacket.

2. Description of the Prior Art

Referring to the water-cooled engine provided with the radiator in its front part, the cooling water inlet and outlet are formed through the lower front part and the upper part of the water-jacket, respectively, and the inlet and the outlet communicate with the lower tank and the upper tank of the radiator, respectively. Through above flow circuit of the cooling-water, the cooling-water circulates between the water-jacket and the radiator, whereby the combustion chambers are cooled.

However, according to such prior cooling apparatus structure, following vital defects were inevitable and caused many problems. For example, in case of the water-cooled engines mounted on an agricultural machine, it is often necessary to operate the engine in the inclined condition toward front for many hours. And in such a case, the steam generated in the water-jacket remains in the upper backward part of the jacket, and this part is filled with the steam instead of the cooling-water, wherein water cooling cannot be done effectively, and therefore overheated steam causes vapourization of the cooling-water and enlarges the vapour space.

As a result, overheating of the water-jacket around the combustion chamber causes vital damages such as deformations of the cylinder-head and cracks around the suction port or the exhaust port. And sometimes hot water bursts out from the radiator cap attached on the upper tank of the radiator, because of high steam pressure.

The present invention serves to solve the above problems, the characteristics exist in the following.

For preventing gathering of the steam in the upper backward part of the water-jacket, a steam relief device is provided, separately or non-separately with the pressure regulating device for the upper tank of the radiator. According to the present invention, the following effects can be attained. As is provided on the engine, the steam relief device communicates with the upper backward part in the water-jacket. Even when the engine is operated in an inclined position toward front for many hours, the steam with over-pressure never gathers in said upper backward part. Therefore, the steam never fills in the upper backward part of the water-jacket, and the engine can be watercooled effectively. Thus, the above described problems can be solved completely.

SUMMARY OF THE INVENTION

Summary of the invention is described as follows.

Referring to a cooling apparatus for combustion chambers of water cooled engines provided with a radiator mounted on the front part of the engine and a water-jacket around the combustion chambers, the radiator is provided with a lower tank and an upper tank, and the water-jacket is provided with a cooling water inlet perforated through the lower front part of the water-jacket and a cooling water outlet perforated through the upper front part of the water-jacket. The lower tank communicates with the cooling water inlet through an intake pipe, and the upper tank communicates with the cooling water outlet, through an outlet pipe. A pressure regulating cap adjusted to open with the set pressure, is connected on a cooling water make-up port which communicates with the upper tank of the radiator. A steam relief port is perforated through the upper backward part of the water-jacket, and a pressure regulating cap communicates with the above steam relief port.

During operation of the engine, when the steam generated in the water-jacket starts to gather in the upper backward part of the water-jacket and the inner pressure has risen to the set pressure of the pressure regulating cap communicated with the steam relief port, this pressure regulating cap is actuated and opened, whereby the steam in the upper backward part of the water-jacket is exhausted through this pressure regulating cap into the atmosphere.

Hereinbefore, the purpose of the present invention is to prevent overheating of the combustion chambers during operating the engine in an inclined position toward front, by means of relieving the steam gathered in the upper backward part of the water-jacket.

BRIEF EXPLANATION OF THE DRAWINGS

The exact nature of this invention, as well as other objects and advantages thereof, will be readily apparant from consideration of the following specification relating to the accompanying drawings, in which like reference characters designate the same or similar parts throughout the figures thereof.

DETAILED DESCRIPTION OF THE INVENTION

Hereinafter, the detailed description of the first embodiment of the invention will be explained according to FIG. 1.

Figure 1:
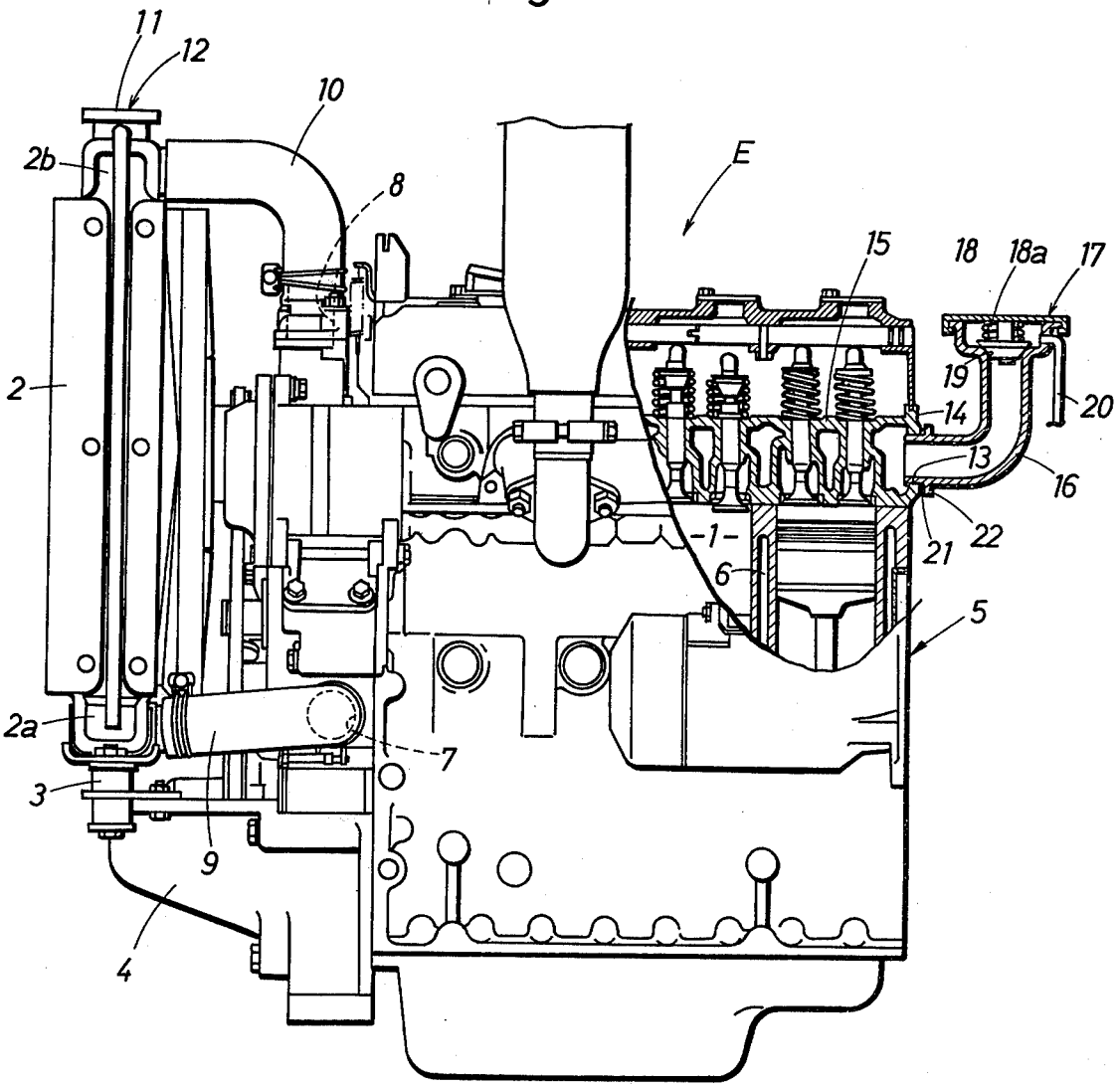
FIG. 1 is a side view of a water cooled vertical diesel engine, partially in section, showing a first embodiment of the invention.

FIG. 1 shows a water cooled vertical diesel engine (E) with plural combustion chambers (1), on whose front part there is mounted a radiator (2), supported on a cushion rubber (3) fixed on a support rack (4) which is stretching out from the lower front of the engine body (5). In the engine body (5), there is constructed a water-jacket (6) surrounding the combustion chambers (1). A cooling water inlet (7) is perforated through the lower front part of the water-jacket (6), a cooling water outlet (8) is perforated through the upper front part of the water-jacket (6). Above cooling water inlet (7) is communicated with the lower tank (2*a*) of the radiator (2) with a cooling water inlet pipe (9), and above cooling water outlet (8) communicates with the upper tank (2*b*) of the radiator (2) through a cooling water outlet pipe (10).

As described above, there is constructed a flow circuit of the cooling water between the radiator (2) and the water-jacket (6). A cooling water make-up port (11) is attached on the upper side of the upper tank (2*b*), and this make-up port (11) is closed with a pressure regulating cap (12) connected on it. This pressure regulating cap (12) is constructed so as to open and relieve the steam in the upper tank (2*b*), when the steam pressure became higher than the set pressure of it.

Furthermore, as shown in partial section of FIG. 1, a steam relief port (13) is perforated through the upper backward part of the water-jacket (6), more concretely through the back end wall (14) of the water-jacket (6) in the cylinder-head (15). And, to this steam relief port (13), there is connected from outside a steam exhaust pipe (16), and this pipe (16) is raised vertically forming an L shape, and a pressure regulating cap (17) is connected on the upper end of the steam exhaust pipe (16).

However, above pressure regulating cap (17) have to be positioned at least higher than the upper surface of the cylinder-head (15). Referring to the structure of the pressure regulating cap (17), the upper end of the steam exhaust pipe (16) is formed enlarged in diameter, and the cap (17) is attached so as to cover the upper open surface of the pipe (16), and this pipe (16) is shut by compressing a valve plate (18) to a valve seat (19) by means of a coil spring (18*a*). This pressure regulating cap (17) is adjusted so as to open, when the steam pressure in the pipe (16) reaches the set pressure, and by this the steam flows into the atmosphere through an overflow pipe (20) whose upper end is connected to the inside of the pressure regulating cap (17). This pressure regulating cap (17) is adjusted to open at the nearly equal set pressure as the set pressure for the pressure regulating cap (12) attached on the upper tank (2*b*).

And however, the character (21) shows an O-ring inserted between the back wall (14) and the flange (22) of the steam exhaust pipe (16).

Relating to above described cooling apparatus, when operating the engine (E) in the normal horizontal condition, almost all of the steam generated in the water-jacket (6) gathers in the upper tank (2*b*) because of the circulating flow of the cooling water, and only little of the steam gathers in the steam exhaust pipe (16), whereby the water-jacket (6) is filled with the cooling water, and therefore the combustion chamber (1) can be cooled effectively.

When operating the engine (E) in inclined condition toward front, some of the steam cannot flow into the upper tank (2*b*), and this steam gathers in the steam pipe (16) and in the upper backward part of the water-jacket (6). And when the steam pressure rises to the set pressure because of starting of incomplete cooling, the pressure regulating cap (17) opens and relieves the steam into the atmosphere. Therefore, the upper backward part of the water-jacket (6) is to be filled with the cooling water, and the combustion chambers (1) and the cylinder head (15) can be cooled effectively.

Figure 2:
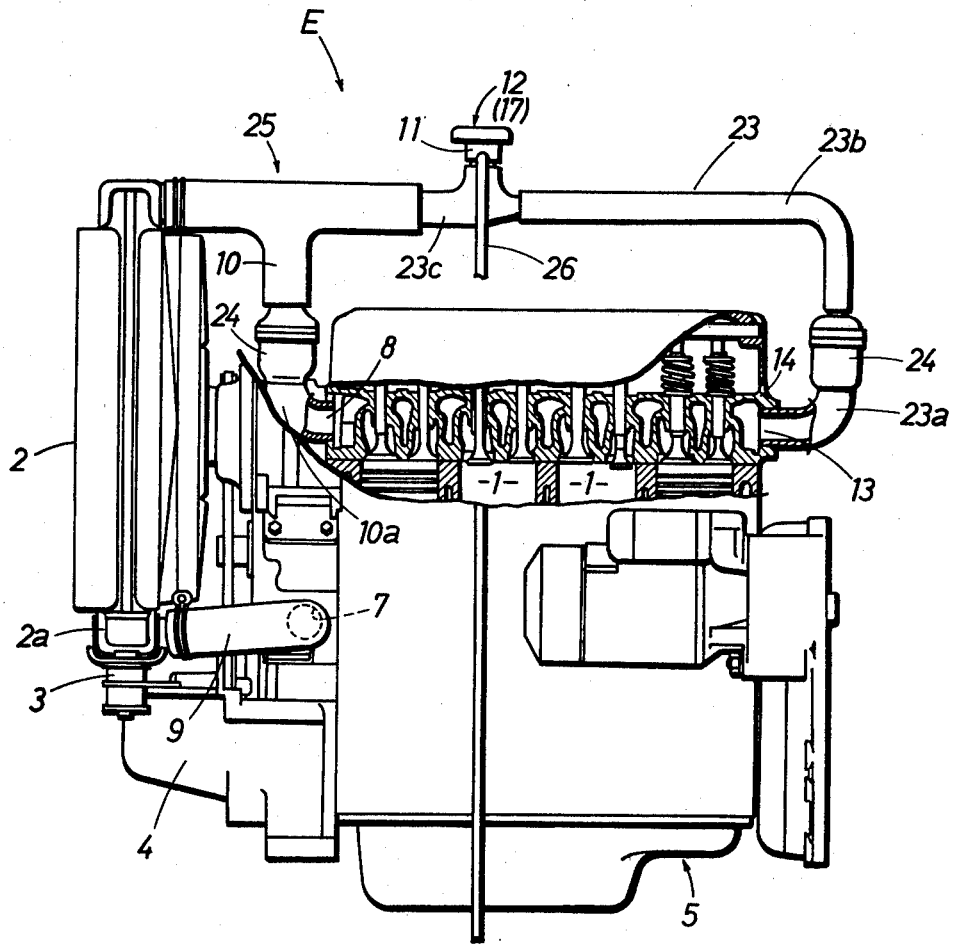
FIG. 2 is a side view of a water cooled vertical diesel engine, partially in section, showing a second embodiment of the invention.

Hereinafter, description relates to the modified second embodiment according to FIG. 2, and modified structure will be described mainly. A communicating pipe (23) is connected to the steam relief port (13) at its lower end, and this pipe (23) is raised vertically forming an L shape, until the same elevation with the upper tank (2*b*), and then runs forward horizontally, and the upper front end of the communicating pipe (23) is connected to the cooling water outlet pipe (10). More particularly, an elbow (10*a*) forming the lowest part of the cooling water outlet pipe (10) is connected to the cooling water outlet (8) at its lower end, a thermostatic control valve (24) is connected to the upper end of this elbow (10*a*) at its inlet port. A T pipe joint (25) of large diameter is connected to the exhaust port of above thermostatic control valve (24) at its lower end, and the front end of this T pipe joint (25) is connected to the upper tank (2*b*) of the radiator (2), and the backward end of the T pipe joint (25) is connected to the front end of a short pipe (23*c*). Referring to the communicating pipe (23), an elbow (23*a*) forming the lowest part of it is connected to the steam relief port (13) at its lower end, and a thermostatic control valve (24) is connected to the upper end of this elbow (23*a*) at its inlet port. The mid part of the communicating pipe (23) is formed with an L pipe (23*b*), and this L pipe (23*b*) is connected to the exhaust port of the valve (24) at its lower end. The backward end of the T pipe joint (25) and the front end of the L pipe (23*b*) are connected with the short pipe (23*c*), and a cooling water make-up port (11) is formed at the highest part of this short pipe (23*c*), and a pressure regulating cap (12) is connected on this make-up port (11). An overflow pipe (26) is lead from this pressure regulating cap (12) to the bottom of the engine body (5). In case of above structure, the pressure regulating cap (12) communicated with the upper tank (2*b*) and the pressure regulating cap (17) communicated with the steam relief port (13) are combined. Here, each thermostatic control valve (24) is adjusted so as to open when the fluid temperature in it is over the set temperature, in order to prevent over heating the combustion chambers (1).

According to above structure of the cooling apparatus, the cooling water flows from the water-jacket (6) into the upper tank (2*b*) through the cooling water outlet pipe (10) and the communicating pipe (23), in normal horizontal condition of the engine (E). In case of inclined condition toward front or back, the steam can be guided effectively through the communicating pipe (23) or the cooling water outlet pipe (10).

Figure 3:
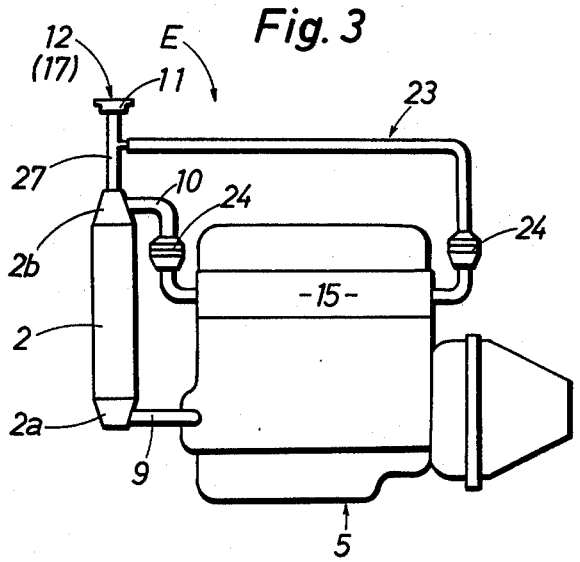
FIG. 3 is a side view of a water cooled vertical diesel engine, showing a third embodiment of the invention.

Hereinafter, description relates to the modified third embodiment as shown in FIG. 3. Instead of connecting the upper front end of the communicating pipe (23) to the cooling water outlet pipe (10), it is connected to the upper tank (2*b*). More particularly, a cooling water make-up pipe (27) is attached on the upper side of the upper tank (2*b*), and a cooling water make-up port (11) is formed on its top. A pressure regulating cap (12) is connected on this make-up port (11), and the upper end of the communicating pipe (23) is connected to the mid part of the make-up pipe (27).

What is claimed is:

1. A cooling system for combustion chambers of a water-cooled engine having a radiator on the front of the engine and a water jacket around the combustion chambers, which cooling system comprises:

(a) an upper tank and a lower tank carried by the radiator;

(b) means providing communication between the lower tank and the water jacket for conducting cooling water into the water jacket from the radiator;

(c) means providing communication between the upper tank and the water jacket for conducting cooling water into the radiator from the water jacket;

(d) a first port at the upper tank for introducing cooling water therein;

(e) a first cap for regulating pressure developed in the upper tank;

(f) a second port at the water jacket at the rear of the engine for releasing steam developed in the upper rear portion of the water jacket;

(g) a second cap for regulating pressure developed at the upper rear portion of the water jacket; and (h) a first conduit connected to the second port at its lower end and to the second cap at its upper end for providing communication between the second port and the second cap, wherein the conduit disposes the second cap about the uppermost portion of the water jacket to permit exhausting steam therefrom into the atmosphere through the second cap and preventing damage from overheating during prolonged operation of the engine in an inclined disposition.

2. The cooling system of claim 1 wherein:

(a) the first cap is attached to and regulates pressure through the first port;

(b) the second cap is attached to and regulates pressure through the second port; and (c) the first and second caps are set to open at substantially the same pressure.

3. A cooling system for combustion chambers of a water-cooled engine having a radiator on the front of the engine and a water jacket around the combustion chambers, which cooling system comprises:

(a) an upper tank and a lower tank carried by the radiator;

(b) means providing communication between the lower tank and the water jacket for conducting cooling water into the water jacket from the radiator;

(c) means providing communication between the upper tank and the water jacket for conducting cooling water into the radiator from the water jacket;

(d) a first port at the upper tank for introducing cooling water therein;

(e) a second port at the water jacket at the rear of the engine for releasing steam developed in the upper rear portion of the water jacket;

(f) a conduit providing communication between the first and second ports;

(g) the conduit includes an upper end and a lower end;

(h) the upper end of the conduit is connected to the upper tank;

(i) the lower end of the conduit is connected to the second port;

(j) a cap in the conduit for regulating pressure developed in the upper tank and the upper rear portion of the water jacket; and (k) wherein the conduit disposes the cap above the uppermost portion of the water jacket to permit exhausting steam therefrom into the atmosphere through the cap and preventing damage from overheating during prolonged operation of the engine in an inclined disposition.

4. A cooling system for combustion chambers of a water-cooled engine having a radiator on the front of the engine and a water jacket around the combustion chambers, which cooling system comprises:

(a) an upper tank and a lower tank carried by the radiator;

(b) means providing communication between the lower tank and the water jacket for conducting cooling water into the water jacket from the radiator;

(c) means providing communication between the upper tank and the water jacket for conducting cooling water into the radiator from the water jacket;

(d) a first port at the upper tank for introducing cooling water therein;

(e) a second port at the water jacket at the rear of the engine for releasing steam developed in the upper rear portion of the water jacket;

(f) a conduit providing communication between the first and second ports;

(g) the conduit includes upper and lower ends;

(h) the second port is connected to the lower end of the conduit;

(i) the conduit is in fluid communication with the means providing communication between the upper tank and the water jacket;

(j) a cap in the conduit for regulating pressure developed in the upper tank and the upper rear portion of the water jacket; and (k) wherein the conduit disposes the cap above the uppermost portion of the water jacket to permit exhausting steam therefrom into the atmosphere through the cap and preventing damage from overheating during prolonged operation of the engine in an inclined disposition.

5. A cooling system for combustion chambers of a water-cooled engine having a radiator on the front of the engine and a water jacket around the combustion chambers, which cooling system comprises:

(a) an upper tank and a lower tank carried by the radiator;

(b) means providing communication between the lower tank and the water jacket for conducting cooling water into the water jacket from the radiator;

(c) means providing communication between the upper tank and the water jacket for conducting cooling water into the radiator from the water jacket;

(d) a first port at the upper tank for introducing cooling water therein;

(e) a first cap for regulating pressure developed in the upper tank;

(f) a second port at the water jacket at the rear of the engine for releasing steam developed in the upper rear portion of the water jacket;

(g) a second cap for regulating pressure developed at the upper rear portion of the water jacket;

(h) a first conduit providing communication between the second port and the second cap, wherein the first conduit disposes the second cap above the uppermost portion of the water jacket to permit exhausting steam therefrom into the atmosphere through the second cap and preventing damage from overheating during prolonged operation of the engine in an inclined disposition;

(i) a second conduit providing communication between the upper tank and the second relief port;

(j) the second conduit includes upper and lower ends, with the lower end being connected to the second port and the upper end being connected to the means providing communication between the upper tank and the water jacket; and (k) the first port and first cap are carried on the second conduit.

6. The cooling system of claims 3, 4 or 5 wherein:

(a) the means providing communication between the upper tank and water jacket includes a thermostatic control valve disposed therein;

(b) the second conduit includes a thermostatic control valve disposed therein; and (c) wherein each thermostatic control valve is set to open at a predetermined fluid temperature.

* * * * *